US009719208B2

(12) United States Patent
Nonni et al.

(10) Patent No.: US 9,719,208 B2
(45) Date of Patent: Aug. 1, 2017

(54) LOW VISCOSITY KRAFT FIBER HAVING REDUCED YELLOWING PROPERTIES AND METHODS OF MAKING AND USING THE SAME

(75) Inventors: Arthur J. Nonni, Peachtree City, GA (US); Charles E. Courchene, Snellville, GA (US); Philip R. Campbell, Salisbury, CT (US); Steven C. Dowdle, Pace, FL (US); Joel Mark Engle, Purvis, MS (US); Christopher Michael Slone, Atlanta, GA (US)

(73) Assignee: GP Cellulose GmbH, Zug (CH)

( * ) Notice: Subject to any disclaimer, the term of this patent is extended or adjusted under 35 U.S.C. 154(b) by 320 days.

(21) Appl. No.: 14/119,605

(22) PCT Filed: May 18, 2012

(86) PCT No.: PCT/US2012/038685

§ 371 (c)(1),
(2), (4) Date: Jul. 3, 2014

(87) PCT Pub. No.: WO2012/170183

PCT Pub. Date: Dec. 13, 2012

(65) Prior Publication Data

US 2014/0318725 A1 Oct. 30, 2014

Related U.S. Application Data

(60) Provisional application No. 61/489,245, filed on May 23, 2011, provisional application No. 61/489,594, filed on May 24, 2011.

(51) Int. Cl.

| | |
|---|---|
| ***D21C 9/12*** | (2006.01) |
| ***D21C 9/14*** | (2006.01) |
| ***D21C 9/147*** | (2006.01) |
| ***D21H 11/04*** | (2006.01) |

(52) U.S. Cl.
CPC ..... *D21C 9/123* (2013.01); *D21C 9/144* (2013.01); *D21C 9/147* (2013.01); *D21H 11/04* (2013.01)

(58) Field of Classification Search
CPC ..... D21C 3/02; D21C 9/1057
See application file for complete search history.

(56) References Cited

U.S. PATENT DOCUMENTS

| | | | |
|---|---|---|---|
| 1,860,431 | A | 5/1932 | Richter |
| 2,112,116 | A | 3/1938 | Richter |
| 2,368,527 | A | 1/1945 | Edelstein |
| 2,749,336 | A | 6/1956 | Boddicker et al. |
| 2,978,446 | A | 4/1961 | Battista et al. |
| 3,728,331 | A | 4/1973 | Savage |
| 3,868,955 | A | 3/1975 | Steiger et al. |
| 4,410,397 | A | 10/1983 | Kempf |
| 4,661,205 | A | 4/1987 | Ow et al. |
| H479 | H | 6/1988 | Wood et al. |
| 5,302,248 | A | 4/1994 | Weinstock et al. |
| 5,346,589 | A | 9/1994 | Braunstein et al. |
| 5,447,602 | A | 9/1995 | Sajbel et al. |
| 5,522,967 | A | 6/1996 | Shet |
| 5,552,019 | A | 9/1996 | Weinstock et al. |
| 5,562,645 | A | 10/1996 | Tanzer et al. |
| 5,580,485 | A | 12/1996 | Feringa et al. |
| 5,593,543 | A | 1/1997 | Balos et al. |
| 5,630,906 | A | 5/1997 | Boe et al. |
| 5,639,348 | A | 6/1997 | Payton et al. |
| 5,703,225 | A | 12/1997 | Shet et al. |
| 5,853,428 | A | 12/1998 | Collins et al. |
| 5,876,625 | A | 3/1999 | Collins et al. |
| 5,994,531 | A | 11/1999 | Doenges et al. |
| 6,099,586 | A | 8/2000 | Collins et al. |
| 6,100,441 | A | 8/2000 | Blomstrom et al. |
| 6,136,223 | A | 10/2000 | Collins et al. |
| 6,146,494 | A | 11/2000 | Seger et al. |
| 6,210,801 | B1 | 4/2001 | Luo et al. |
| 6,214,976 | B1 | 4/2001 | Watanabe et al. |
| 6,221,487 | B1 | 4/2001 | Luo et al. |
| 6,228,126 | B1 | 5/2001 | Cimecioglu et al. |
| 6,235,154 | B1 * | 5/2001 | Jiang ..... D21C 9/1036 162/65 |
| 6,235,392 | B1 | 5/2001 | Luo et al. |
| 6,241,779 | B1 | 6/2001 | Collins et al. |
| 6,306,334 | B1 | 10/2001 | Luo et al. |
| 6,319,361 | B1 | 11/2001 | Smith et al. |
| 6,331,354 | B1 | 12/2001 | Sealey, II et al. |
| 6,368,456 | B1 | 4/2002 | Cimecioglu et al. |
| 6,379,494 | B1 | 4/2002 | Jewell et al. |

(Continued)

FOREIGN PATENT DOCUMENTS

| | | |
|---|---|---|
| CA | 1129161 | 8/1982 |
| DE | 19620241 | 11/1997 |
| EP | 0172135 | 2/1986 |
| EP | 2226414 | 6/1987 |
| EP | 0647158 | 8/1997 |
| EP | 0845966 | 3/2000 |
| EP | 0999222 | 5/2000 |
| EP | 1077285 | 2/2001 |
| EP | 1106732 | 6/2001 |
| EP | 1154074 | 11/2001 |

(Continued)

OTHER PUBLICATIONS

Norden et al., Bleaching of Extremely Low Kappa Southern Pine, Cooked by the SuperbAtch Process, 1992, TAPPI Pulping Conference, p. 159-168.*
Sixta Editor, Handbook of Pulp, 2006, p. 366-509.*
TAPPI, T-525 om-92, 1992, TAPPI.*

(Continued)

*Primary Examiner* — Anthony Calandra
(74) *Attorney, Agent, or Firm* — Ram W. Sabnis

(57) ABSTRACT

A bleached softwood kraft pulp fiber with high alpha cellulose content and increased brightness and whiteness is provided. Methods for making the kraft fiber and products made from it are also described.

21 Claims, No Drawings

(56) References Cited

U.S. PATENT DOCUMENTS

| | | | |
|---|---|---|---|
| 6,398,908 | B1 | 6/2002 | Hermansson et al. |
| 6,432,266 | B1 | 8/2002 | Fukushima et al. |
| 6,440,523 | B1 | 8/2002 | Sealey, II et al. |
| 6,440,547 | B1 | 8/2002 | Luo et al. |
| 6,444,314 | B1 | 9/2002 | Luo et al. |
| 6,471,727 | B2 | 10/2002 | Luo et al. |
| 6,491,788 | B2 | 12/2002 | Sealey, II et al. |
| 6,511,930 | B1 | 1/2003 | Luo et al. |
| 6,514,613 | B2 | 2/2003 | Luo et al. |
| 6,515,049 | B1 | 2/2003 | Doenges et al. |
| 6,518,419 | B1 | 2/2003 | Van Der Lugt et al. |
| 6,524,348 | B1 | 2/2003 | Jewell et al. |
| 6,528,163 | B2 | 3/2003 | Sealey, II et al. |
| 6,540,876 | B1 | 4/2003 | Cimecioglu et al. |
| 6,541,627 | B1 | 4/2003 | Ono et al. |
| 6,562,195 | B2 | 5/2003 | Cimecioglu et al. |
| 6,582,559 | B2 | 6/2003 | Thornton et al. |
| 6,586,588 | B1 | 7/2003 | Cimecioglu et al. |
| 6,596,033 | B1 | 7/2003 | Luo et al. |
| 6,605,181 | B1 | 8/2003 | Bergqvist et al. |
| 6,605,350 | B1 | 8/2003 | Sealey, II et al. |
| 6,627,749 | B1 | 9/2003 | Kumar |
| 6,635,755 | B1 | 10/2003 | Jaschinski et al. |
| 6,685,856 | B2 | 2/2004 | Sealey, II et al. |
| 6,686,039 | B2 | 2/2004 | Sealey, II et al. |
| 6,686,040 | B2 | 2/2004 | Sealey, II et al. |
| 6,686,464 | B1 | 2/2004 | Harding et al. |
| 6,692,827 | B2 | 2/2004 | Luo et al. |
| 6,695,950 | B1 | 2/2004 | Cimecioglu et al. |
| 6,706,237 | B2 | 3/2004 | Luo et al. |
| 6,706,876 | B2 | 3/2004 | Luo et al. |
| 6,716,976 | B1 | 4/2004 | Jetten et al. |
| 6,765,042 | B1 | 7/2004 | Thornton et al. |
| 6,770,755 | B1 | 8/2004 | Gunnars et al. |
| 6,773,648 | B2 | 8/2004 | Luo et al. |
| 6,797,113 | B2 | 9/2004 | Sealey, II et al. |
| 6,821,383 | B2 | 11/2004 | Shore et al. |
| 6,824,645 | B2 | 11/2004 | Jaschinski et al. |
| 6,849,156 | B2 | 2/2005 | Besemer et al. |
| 6,861,023 | B2 | 3/2005 | Sealey, II et al. |
| 6,872,821 | B2 | 3/2005 | Cimecioglu et al. |
| 6,896,725 | B2 | 5/2005 | Thornton et al. |
| 6,916,466 | B2 | 7/2005 | Besemer et al. |
| 6,924,369 | B2 | 8/2005 | Doenges et al. |
| 6,936,710 | B2 | 8/2005 | Bragt et al. |
| 6,958,108 | B1 | 10/2005 | Vuorinen |
| 6,987,181 | B2 | 1/2006 | Jaschinski et al. |
| 7,001,483 | B2 | 2/2006 | Severeid et al. |
| 7,019,191 | B2 | 3/2006 | Looney et al. |
| 7,022,837 | B2 | 4/2006 | Harding et al. |
| 7,067,444 | B2 | 6/2006 | Luo et al. |
| 7,083,704 | B2 | 8/2006 | Sealey, II et al. |
| 7,090,744 | B2 | 8/2006 | Sealey, II et al. |
| 7,161,005 | B2 | 1/2007 | Schlingloff et al. |
| 7,247,722 | B2 | 7/2007 | Cimecioglu et al. |
| 7,252,837 | B2 | 8/2007 | Guo et al. |
| 7,279,177 | B2 | 10/2007 | Looney et al. |
| 7,326,317 | B2 | 2/2008 | Westermark et al. |
| 7,390,566 | B2 | 6/2008 | Luo et al. |
| 7,411,110 | B2 | 8/2008 | Sawyer et al. |
| 7,455,902 | B2 | 11/2008 | Weerawarna et al. |
| 7,456,285 | B2 | 11/2008 | Schlingloff et al. |
| 7,520,958 | B2 | 4/2009 | Tan et al. |
| 7,541,396 | B2 | 6/2009 | Luo et al. |
| 7,608,167 | B2 | 10/2009 | Luo et al. |
| 7,692,004 | B2 | 4/2010 | Schlingloff et al. |
| 7,700,764 | B2 | 4/2010 | Heijnesson-Hulten |
| 7,708,214 | B2 | 5/2010 | Medoff |
| 7,727,945 | B2 | 6/2010 | Rodrigues et al. |
| 7,867,358 | B2 | 1/2011 | Medoff |
| 7,867,359 | B2 | 1/2011 | Medoff |
| 7,939,101 | B2 | 5/2011 | Obae et al. |
| 7,947,292 | B2 | 5/2011 | Besemer et al. |
| 7,955,536 | B2 | 6/2011 | Sawyer et al. |
| 7,971,809 | B2 | 7/2011 | Medoff |
| 7,976,676 | B2 | 7/2011 | Yin et al. |
| 8,007,635 | B2 | 8/2011 | Tan et al. |
| 8,029,896 | B2 | 10/2011 | Kumamoto et al. |
| 8,044,013 | B2 | 10/2011 | Schlingloff et al. |
| 8,057,636 | B2 | 11/2011 | Vinson et al. |
| 8,084,391 | B2 | 12/2011 | Weerawarna |
| 8,372,765 | B2 | 2/2013 | Braig et al. |
| 2001/0025695 | A1 | 10/2001 | Patt et al. |
| 2001/0050153 | A1 | 12/2001 | Wajer et al. |
| 2005/0061455 | A1 | 3/2005 | Tan et al. |
| 2006/0070711 | A1 | 4/2006 | Luo |
| 2006/0159733 | A1 | 7/2006 | Pendharkar et al. |
| 2006/0260773 | A1 | 11/2006 | Tan et al. |
| 2007/0000627 | A1 | 1/2007 | Tan et al. |
| 2007/0119556 | A1 | 5/2007 | Tan et al. |
| 2007/0125507 | A1 | 6/2007 | Walter et al. |
| 2007/0199668 | A1 | 8/2007 | Scarpello et al. |
| 2007/0272377 | A1 | 11/2007 | Mei et al. |
| 2007/0277947 | A1 | 12/2007 | Nguyen |
| 2008/0188636 | A1 | 8/2008 | Argyropoulos et al. |
| 2008/0308239 | A1 | 12/2008 | Hart et al. |
| 2009/0044345 | A1 | 2/2009 | Schlingloff et al. |
| 2009/0054863 | A1 | 2/2009 | Tan et al. |
| 2009/0165968 | A1 | 7/2009 | Tan et al. |
| 2009/0312537 | A1 | 12/2009 | Medoff |
| 2010/0055437 | A1 | 3/2010 | Fink et al. |
| 2010/0124583 | A1 | 5/2010 | Medoff |
| 2010/0206501 | A1 | 8/2010 | Medoff |
| 2010/0233481 | A1 | 9/2010 | Isogai et al. |
| 2010/0282422 | A1 | 11/2010 | Miyawaki et al. |
| 2010/0316863 | A1 | 12/2010 | Kumamoto et al. |
| 2010/0320156 | A1 | 12/2010 | Olaiya et al. |
| 2011/0139383 | A1 | 6/2011 | Medoff |
| 2011/0287275 | A1 | 11/2011 | Tan et al. |
| 2012/0004194 | A1 | 1/2012 | Lu et al. |

FOREIGN PATENT DOCUMENTS

| | | |
|---|---|---|
| EP | 1156065 | 11/2001 |
| EP | 1093467 | 3/2002 |
| EP | 0889997 | 7/2002 |
| EP | 0923635 | 2/2003 |
| EP | 1300420 | 4/2003 |
| EP | 0787231 | 5/2003 |
| EP | 1228099 | 9/2003 |
| EP | 1025305 | 11/2003 |
| EP | 1068376 | 11/2003 |
| EP | 0511695 | 6/2004 |
| EP | 1430911 | 6/2004 |
| EP | 1155039 | 7/2004 |
| EP | 0863158 | 11/2004 |
| EP | 1077286 | 2/2005 |
| EP | 1541590 | 6/2005 |
| EP | 1278913 | 11/2005 |
| EP | 1155040 | 4/2006 |
| EP | 1383857 | 5/2006 |
| EP | 1245722 | 6/2006 |
| EP | 1230456 | 7/2006 |
| EP | 1676863 | 7/2006 |
| EP | 1311717 | 8/2006 |
| EP | 1137672 | 12/2006 |
| EP | 1743906 | 1/2007 |
| EP | 1668180 | 8/2007 |
| EP | 1862587 | 12/2007 |
| EP | 2084325 | 4/2010 |
| EP | 2216345 | 8/2010 |
| EP | 1694711 | 12/2010 |
| JP | S48-34522 | 10/1973 |
| JP | 2002-506935 | 3/2002 |
| WO | WO 92/14760 | 9/1992 |
| WO | WO 94/20673 | 9/1994 |
| WO | WO 94/21690 | 9/1994 |
| WO | WO 95/06157 | 3/1995 |
| WO | WO 95/26438 | 10/1995 |
| WO | WO 95/34628 | 12/1995 |
| WO | WO 95/35406 | 12/1995 |
| WO | WO 96/09434 | 3/1996 |
| WO | WO 96/20667 | 7/1996 |
| WO | WO 96/38111 | 12/1996 |

(56) References Cited

FOREIGN PATENT DOCUMENTS

| | | |
|---|---|---|
| WO | WO 98/03626 | 1/1998 |
| WO | WO 98/56981 | 12/1998 |
| WO | WO 99/09244 | 2/1999 |
| WO | WO 99/47733 | 9/1999 |
| WO | WO 99/47744 | 9/1999 |
| WO | WO 99/57158 | 11/1999 |
| WO | WO 99/57370 | 11/1999 |
| WO | WO 00/26257 | 5/2000 |
| WO | WO 00/50462 | 8/2000 |
| WO | WO 00/50463 | 8/2000 |
| WO | WO 00/65145 | 11/2000 |
| WO | WO 01/29309 | 4/2001 |
| WO | WO 01/34656 | 5/2001 |
| WO | WO 01/34657 | 5/2001 |
| WO | WO 01/83887 | 11/2001 |
| WO | WO 01/88236 | 11/2001 |
| WO | WO 02/48196 | 6/2002 |
| WO | WO 02/48197 | 6/2002 |
| WO | WO 02/49565 | 6/2002 |
| WO | WO 02/086206 | 10/2002 |
| WO | WO 02/088289 | 11/2002 |
| WO | WO 03/006739 | 1/2003 |
| WO | WO 03/042451 | 5/2003 |
| WO | WO 2004/062703 | 7/2004 |
| WO | WO 2005/028744 | 3/2005 |
| WO | WO 2005/058972 | 6/2005 |
| WO | WO 2005/068074 | 7/2005 |
| WO | WO 2006/102543 | 9/2006 |
| WO | WO 2006/119392 | 11/2006 |
| WO | WO 2006/125517 | 11/2006 |
| WO | WO 2007/042192 | 4/2007 |
| WO | WO 2007/090461 | 8/2007 |
| WO | WO 2008/010187 | 1/2008 |
| WO | WO 2008/098037 | 8/2008 |
| WO | WO 2008/153565 | 12/2008 |
| WO | WO 2008/154073 | 12/2008 |
| WO | WO 2009/134746 | 11/2009 |
| WO | WO 2010/025224 | 3/2010 |
| WO | WO 2011/002956 | 1/2011 |
| WO | WO 2011/088889 | 7/2011 |
| WO | WO 2011/089123 | 7/2011 |
| WO | WO 2011/090425 | 7/2011 |
| WO | WO 2010/138941 | 12/2012 |

OTHER PUBLICATIONS

Adam Wojciak et al., "Direct Characterization of Hydrogen Peroxide Bleached Thermomechanical Pulp Using Spectroscopic Methods," J. Phys. Chem. A., vol. 111, pp. 10530-10536, 2007.

Burgess, "Relationships Between Colour Production in Cellulose and the Chemical Changes Brought About by Bleaching," Transcript of a Lecture given at the Meeting of the Book and Paper Specialty Group, AIC Annual Meeting, Milwaukee, May 27-30, 1982 (http://cool.conversation-us.org/coolaic/sg/bpg/annual/v01/bp01-05.html).

Easty et al., "Estimation of Pulp Yield in Continuous Digesters from Carbohydrate and Lignin Determinations," TAPPI Journal 65(12):78-80 (1982).

Gullichsen, "Chemical Pulping," Papermaking Science and Technology, Book 6A, pp. A635-A665, 1992.

International Preliminary Report on Patentability dated Nov. 29, 2011, issued in priority PCT Application No. PCT/US2010/036763.

International Search Report dated Apr. 7, 2011, in International No. PCT/US2010/03673.

Kubelka et al., "Delignification with Acidic Hydrogen Peroxide Activated by Molybdate," Journal of Pulp and Paper Science: vol. 18, No. 3, May 1992, pp. J108-J114.

Luc Lapierre et al., "The Effect of Magnesium Ions and Chelants on Peroxide Bleaching," Holzforschung, vol. 57, No. 6, pp. 627-633, 2003.

Qian, "The Chemical Mechanism of a Brown-Rot Decay Mimtic System and its Application in paper Recycling Processes," [Chapter 4: The Effects of Chelator Mediated Fenton System on the Fiber and Paper Properties of Hardwood Kraft Pulp], 2001, *Electronic Theses and Dissertations*, Paper 505.

Rohrling et al., "A novel method for the determination of carbonyl groups in cellulosics by fluorescence labeling. 2. Validation and applications," Biomacromolecules 2002, Sep.-Oct.; 3(5): 969-975.

Song et al., Novel antiviral activity of dialdehyde starch, Electronic J. Biotech., vol. 12, No. 2, 2009.

Suchy et al., "Catalysis and Activation of Oxygen and Peroxide Delignification of Chemical Pulps; A Review," Miscellaneous Report, Pulp and Paper Research Institute of Canada, 1999, pp. 1-32.

Zheng Dang et al., "Alkaline peroxide treatment of ECF bleached softwood kraft pulps. Part 1. Characterizing the effect of alkaline peroxide treatment on carboxyl groups of fibers," Holzforschung,vol. 61, pp. 445-450, 2007.

Zheng Dang, "The Investigation of Carboxyl Groups of Pulp Fibers During Kraft Pulping, Alkaline Peroxide Bleaching, and TEMPO-mediated Oxication," Georgia Institute of Technology, Aug. 2007.

Norden, Solveig et al., "Bleaching of Extremely Low Kappa Southern Pine, Cooked by the Superbatch™ Process," 1992 Pulping Conference, TAPPI Proceedings, 1992 Pulping Conference, pp. 159-168.

Smook, G.A., Handbook for Pulp & Paper Technologists ('3rd Edition), Chapter 7 (2003).

* cited by examiner

LOW VISCOSITY KRAFT FIBER HAVING REDUCED YELLOWING PROPERTIES AND METHODS OF MAKING AND USING THE SAME

CROSS REFERENCE TO RELATED APPLICATIONS

This application is a national phase application based on PCT/US2012/038685, filed May 18, 2012, which claims the benefit of U.S. Provisional Application No. 61/489,245, filed May 23, 2011 and U.S. Provisional Application No. 61/489,594, filed May 24, 2011; the content of all of which is incorporated herein by reference.

TECHNICAL FIELD

This disclosure relates to softwood, more particularly southern pine, kraft fiber having improved whiteness and brightness. More particularly, this disclosure relates to softwood fiber, e.g., southern pine fiber, that exhibits a unique set of characteristics, improving its performance over standard cellulose fiber derived from kraft pulp and making it useful in applications that have heretofore been limited to expensive fibers (e.g., cotton or high alpha content sulfite pulp).

This disclosure also relates to methods for producing the improved fiber described.

Finally, this disclosure relates to products produced using the improved softwood fiber as described.

BACKGROUND

Cellulose fiber and derivatives are widely used in paper, absorbent products, food or food-related applications, pharmaceuticals, and in industrial applications. The main sources of cellulose fiber are wood pulp and cotton. The cellulose source and the cellulose processing conditions generally dictate the cellulose fiber characteristics, and therefore, the fiber's applicability for certain end uses. A need exists for cellulose fiber that is relatively inexpensive to process, yet is highly versatile, enabling its use in a variety of applications.

Kraft fiber, produced by a chemical kraft pulping method, provides an inexpensive source of cellulose fiber that generally provides final products with good brightness and strength characteristics. As such, it is widely used in paper applications. However, standard kraft fiber has limited applicability in downstream applications, such as cellulose derivative production, due to the chemical structure of the cellulose resulting from standard kraft pulping and bleaching. In general, standard kraft fiber contains too much residual hemicellulose and other naturally occurring materials that may interfere with the subsequent physical and/or chemical modification of the fiber. Moreover, standard kraft fiber has limited chemical functionality, and is generally rigid and not highly compressible.

In the standard kraft process a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood.

Generally, the temperature of the wood/liquor mixture in the digester is maintained at about 145° C. to 170° C. for a total reaction time of about 1-3 hours. When digestion is complete the resulting kraft wood pulp is separated from the spent liquor (black liquor) which includes the used chemicals and dissolved lignin. Conventionally, the black liquor is burnt in a kraft recovery process to recover the sodium and sulphur chemicals for reuse.

At this stage, the kraft pulp exhibits a characteristic brownish color due to lignin residues that remain on the cellulose fiber. Following digestion and washing, the fiber is often bleached to remove additional lignin and whiten and brighten the fiber. Because bleaching chemicals are much more expensive than cooking chemicals, typically, as much lignin as possible is removed during the cooking process. However, it is understood that these processes need to be balanced because removing too much lignin can increase cellulose degradation. The typical Kappa number (the measure used to determine the amount of residual lignin in pulp) of softwood after cooking and prior to bleaching is in the range of 28 to 32.

Following digestion and washing, the fiber is generally bleached in multi-stage sequences, which traditionally comprise strongly acidic and strongly alkaline bleaching steps, including at least one alkaline step at or near the end of the bleaching sequence. Bleaching of wood pulp is generally conducted with the aim of selectively increasing the whiteness or brightness of the pulp, typically by removing lignin and other impurities, without negatively affecting physical properties. Bleaching of chemical pulps, such as kraft pulps, generally requires several different bleaching stages to achieve a desired brightness with good selectivity. Typically, a bleaching sequence employs stages conducted at alternating pH ranges. This alternation aids in the removal of impurities generated in the bleaching sequence, for example, by solubilizing the products of lignin breakdown. Thus, in general, it is expected that using a series of acidic stages in a bleaching sequence, such as three acidic stages in sequence, would not provide the same brightness as alternating acidic/alkaline stages, such as acidic-alkaline-acidic. For instance, a typical DEDED sequence produces a brighter product than a DEDAD sequence (where A refers to an acid treatment).

Traditionally, cellulose sources that were useful in the production of absorbent products or tissue were not also useful in the production of downstream cellulose derivatives, such as cellulose ethers and cellulose esters. The production of low viscosity cellulose derivatives from high viscosity cellulose raw materials, such as standard kraft fiber, requires additional manufacturing steps that would add significant cost while imparting unwanted by-products and reducing the overall quality of the cellulose derivative. Cotton linter and high alpha cellulose content sulfite pulps, which generally have a high degree of polymerization, are typically used in the manufacture of cellulose derivatives such as cellulose ethers and esters. However, production of cotton linters and sulfite fiber with a high degree of polymerization (DP) and/or viscosity is expensive due to 1) the cost of the starting material, in the case of cotton; 2) the high energy, chemical, and environmental costs of pulping and bleaching, in the case of sulfite pulps; and 3) the extensive purifying processes required, which applies in both cases. In addition to the high cost, there is a dwindling supply of sulfite pulps available to the market. Therefore, these fibers are very expensive, and have limited applicability in pulp and paper applications, for example, where higher purity or higher viscosity pulps may be required. For cellulose derivative manufacturers these pulps constitute a significant portion of their overall manufacturing cost. Thus, there exists a need for high purity, white, bright, low cost fibers, such as a kraft fiber, that may be used in the production of cellulose derivatives.

There is also a need for inexpensive cellulose materials that can be used in the manufacture of microcrystalline cellulose. Microcrystalline cellulose is widely used in food, pharmaceutical, cosmetic, and industrial applications, and is a purified crystalline form of partially depolymerized cellulose. The use of kraft fiber in microcrystalline cellulose production, without the addition of extensive post-bleaching processing steps, has heretofore been limited. Microcrystalline cellulose production generally requires a highly purified cellulosic starting material, which is acid hydrolyzed to remove amorphous segments of the cellulose chain. See U.S. Pat. No. 2,978,446 to Battista et al. and U.S. Pat. No. 5,346,589 to Braunstein et al. A low degree of polymerization of the chains upon removal of the amorphous segments of cellulose, termed the "level-off DP," is frequently a starting point for microcrystalline cellulose production and its numerical value depends primarily on the source and the processing of the cellulose fibers. The dissolution of the non-crystalline segments from standard kraft fiber generally degrades the fiber to an extent that renders it unsuitable for most applications because of at least one of 1) remaining impurities; 2) a lack of sufficiently long crystalline segments; or 3) it results in a cellulose fiber having too high a degree of polymerization, typically in the range of 200 to 400, to make it useful in the production of microcrystalline cellulose. Kraft fiber having an increased alpha cellulose content, for example, would be desirable, as the kraft fiber may provide greater versatility in microcrystalline cellulose production and applications.

In the present disclosure, fiber having one or more of the described properties can be produced simply through modification of a kraft pulping plus bleaching process. Fiber of the present disclosure overcomes many of the limitations associated with known kraft fiber discussed herein.

The methods of the present disclosure result in products that have characteristics that are very surprising and contrary to those predicted based on the teachings of the prior art. Thus, the methods of the disclosure may provide products that are superior to the products of the prior art and can be more cost-effectively produced.

DESCRIPTION

I. Methods

The present disclosure provides novel methods for producing cellulose fiber. The method comprises subjecting cellulose to a kraft pulping step, an oxygen delignification step, and a bleaching sequence. In one embodiment, the conditions under which the cellulose is processed result in softwood fiber exhibiting high whiteness and high brightness while maintaining a high alpha cellulose content.

The cellulose fiber used in the methods described-herein may be derived from softwood fiber. The softwood fiber may be derived from any known source, including but not limited to, pine, spruce and fir. In some embodiments, the cellulose fiber is derived from southern pine.

References in this disclosure to "cellulose fiber" or "kraft fiber" are interchangeable except where specifically indicated as different or as one of ordinary skill in the art would understand them to be different.

In one method of the invention, cellulose, preferably southern pine, is digested in a two-vessel hydraulic digester with, Lo-Solids™ cooking to a kappa number ranging from about 17 to about 21. The resulting pulp is subjected to oxygen delignification until it reaches a kappa number of about 8 or below. Finally, the cellulose pulp is bleached in a multi-stage bleaching sequence until it reaches an ISO brightness of at least about 92.

In one embodiment, the method comprises digesting the cellulose fiber in a continuous digester with a co-current, down-flow arrangement. The effective alkali of the white liquor charge is at least about 16%, for example, at least about 16.4%, for example at least about 16.7%, for example, at least about 17%, for example at least about 18%. In one embodiment, the white liquor charge is divided with a portion of the white liquor being applied to the cellulose in the impregnator and the remainder of the white liquor being applied to the pulp in the digester. According to one embodiment, the white liquor is applied in a 50:50 ratio. In another embodiment, the white liquor is applied in a range of from 90:10 to 30:70, for example in a range from 50:50 to 70:30, for example 60:40. According to one embodiment, the white liquor is added to the digester in a series of stages. According to one embodiment, digestion is carried out at a temperature between about 320° F. to about 335° F., for example, from about 325° F. to about 330° F., for example, from about 325° F. to about 328° F., and the cellulose is treated until a target kappa number between about 17 and about 21 is reached. The higher than normal effective alkali ("EA") and higher temperature achieved the lower than normal Kappa number.

According to one embodiment of the invention, the digester is run with an increase in push flow which essentially increases the liquid to wood ratio as the cellulose enters the digester. This addition of white liquor assists in maintaining the digester at a hydraulic equilibrium and assists in achieving a continuous down-flow condition in the digester.

In one embodiment, the method comprises oxygen delignifying the cellulose fiber after it has been cooked to a kappa number of about 17 to about 21 to further reduce the lignin content and further reduce the kappa number, prior to bleaching. Oxygen delignification can be performed by any method known to those of ordinary skill in the art. For instance, oxygen delignification may be a conventional two-stage oxygen delignification. Advantageously, the delignification is carried out to a target kappa number of about 8 or lower, more particularly about 6 to about 8.

In one embodiment, during oxygen delignification the applied oxygen is less than about 2%, for example, less than about 1.9%, for example, less than about 1.7%. According to one embodiment, fresh caustic is added to the cellulose during oxygen delignification. Fresh caustic may be added in an amount of from about 2.5% to about 3.8%, for example, from about 3% to about 3.2%. According to one embodiment, the ratio of oxygen to caustic is reduced over standard kraft production however the absolute amount of oxygen remains the same. Delignification was carried out at a temperature of from about 200° F. to about 220° F., for example, from about 205° F. to about 215° F., for example, from about 209° F. to about 211° F.

After the fiber has reaches a Kappa Number of about 8 or less, the fiber is subjected to a multi-stage bleaching sequence. The stages of the multi-stage bleaching sequence may include any conventional or after discovered series of stages and may be conducted under conventional conditions.

In some embodiments, prior to bleaching the pH of the cellulose is adjusted to a pH ranging from about 2 to about 6, for example from about 2 to about 5 or from about 2 to about 4, or from about 2 to about 3.

The pH can be adjusted using any suitable acid, as a person of skill would recognize, for example, sulfuric acid or hydrochloric acid or filtrate from an acidic bleach stage of a bleaching process, such as a chlorine dioxide (D) stage of a multi-stage bleaching process. For example, the cellulose fiber may be acidified by adding an extraneous acid. Examples of extraneous acids are known in the art and include, but are not limited to, sulfuric acid, hydrochloric acid, and carbonic acid. In some embodiments, the cellulose fiber is acidified with acidic filtrate, such as waste filtrate, from a bleaching step. In at least one embodiment, the cellulose fiber is acidified with acidic filtrate from a D stage of a multi-stage bleaching process.

In some embodiments, the bleaching sequence is a DEDED sequence. In some embodiments, the bleaching sequence is a D(EoP)D(EP)D. In some embodiments, the bleaching sequence is a $D_0$E1D1E2D2 sequence. In some embodiments, the bleaching sequence is a $D_0$(EoP)D1E2D2 sequence. In some embodiments the bleaching sequence is a $D_0$(EO)D1E2D2.

According to one embodiment, the cellulose is subjected to a D(EoP)D(EP)D bleaching sequence. According to one embodiment, the first D stage ($D_0$) of the bleaching sequence is carried out at a temperature of at least about 135° F., for example at least about 140° F., for example, at least about 150° F., for example, at least about 160° F. and at a pH of less than about 3, for example about 2.5. Chlorine dioxide is applied in an amount of greater than about 1%, for example, greater than about 1.2%, for example about 1.5%. Acid is applied to the cellulose in an amount sufficient to maintain the pH, for example, in an amount of at least about 20 lbs/ton, for example, at least about 23 lbs/ton, for example, at least about 25 lbs/ton.

According to one embodiment, the first E stage ($E_1$), is carried out at a temperature of at least about 170° F., for example at least about 172° F. and at a pH of greater than about 11, for example, greater than 11.2, for example about 11.4. Caustic is applied in an amount of greater than about 0.8%, for example, greater than about 1.0%, for example about 1.25%. Oxygen is applied to the cellulose in an amount of at least about 9.5 lbs/ton, for example, at least about 10 lbs/ton, for example, at least about 10.5 lbs/ton. Hydrogen Peroxide is applied to the cellulose in an amount of at least about 7 lbs/ton, for example at least about 7.3 lbs/ton, for example, at least about 7.5 lbs/ton, for example, at least about 8 lbs/ton, for example, at least about 9 lbs/ton. The skilled artisan would recognize that any known peroxygen compound could be used to replace some or all of the hydrogen peroxide.

In some embodiments, the kappa number may be higher than normal after the first D stage. According to one embodiment of the invention, the kappa number after then D(EoP) stage is about 2.2 or less.

According to one embodiment, the second D stage ($D_1$) of the bleaching sequence is carried out at a temperature of at least about 170° F., for example at least about 175° F., for example, at least about 180° F. and at a pH of less than about 4, for example about 3.7. Chlorine dioxide is applied in an amount of less than about 1%, for example, less than about 0.8%, for example about 0.7%. Caustic is applied to the cellulose in an amount effective to adjust to the desired pH, for example, in an amount of less than about 0.3 lbs/ton, for example, less than about 0.2 lbs/ton, for example, about 0.15 lbs/ton.

According to one embodiment, the second E stage ($E_2$), is carried out at a temperature of at least about 170° F., for example at least about 172° F. and at a pH of greater than about 10.5, for example, greater than about 11, for example greater than about 11.5. Caustic is applied in an amount of less than about 0.6%, for example, less than about 0.5%, for example about 0.4%. Hydrogen peroxide is applied to the cellulose in an amount of less than about 0.3%, for example, less than about 0.2%, for example about 0.1%. The skilled artisan would recognize that any known peroxygen compound could be used to replace some or all of the hydrogen peroxide.

According to one embodiment, the third D stage ($D_2$) of the bleaching sequence is carried out at a temperature of at least about 170° F., for example at least about 175° F., for example, at least about 180° F. and at a pH of less than about 5.5, for example less than about 5.0. Chlorine dioxide is applied in an amount of less than about 0.5%, for example, less than about 0.3%, for example about 0.15%.

In some embodiments, the bleaching process is conducted under conditions to target a final ISO brightness of at least about 91%, for example, at least about 92, for example, at least about 93%.

According to one embodiment, the apparent density of kraft fiber of the invention is at least about 0.59 g/cm$^3$, for example, at least about 0.60 g/cm$^3$, for example, at least about 0.65 g/cm$^3$. Apparent density refers to the density of the pulp fiber after it has been densified on a dryer. The caliper of the kraft fiber board is less than about 1.2 mm, for example, less than about 1.19 mm, for example, less than about 1.18 mm. According to one embodiment, the caliper can be obtained by increasing the calendar loading to 300 pli.

In some embodiments, each stage of the five-stage bleaching process includes at least a mixer, a reactor, and a washer (as is known to those of skill in the art).

In some embodiments, the disclosure provides a method for producing fluff pulp, comprising providing kraft fiber of the disclosure and then producing a fluff pulp. For example, the method comprises bleaching kraft fiber in a multi-stage bleaching process, and then forming a fluff pulp. In at least one embodiment, the fiber is not refined after the multi-stage bleaching process.

In some embodiments, the kraft fiber is combined with at least one super absorbent polymer (SAP). In some embodiments, the SAP may by an odor reductant. Examples of SAP that can be used in accordance with the disclosure include, but are not limited to, Hysorb™ sold by the company BASF, Aqua Keep® sold by the company Sumitomo, and FAVOR®, sold by the company Evonik.

II. Kraft Fibers

Reference is made herein to "standard," "conventional," or "traditional," kraft fiber, kraft bleached fiber, kraft pulp or kraft bleached pulp. Such fiber or pulp is often described as a reference point for defining the improved properties of the present invention. As used herein, these terms are interchangeable and refer to the fiber or pulp which is identical in composition to and processed in a like standard manner. As used herein, a standard kraft process includes both a cooking stage and a bleaching stage under art recognized conditions. Standard kraft processing does not include a pre-hydrolysis stage prior to digestion.

Physical characteristics (for example, purity, brightness, fiber length and viscosity) of the kraft cellulose fiber mentioned in the specification are measured in accordance with protocols provided in the Examples section.

The kraft fiber of the disclosure has a brightness of at least about 91%, about 92% or about 93% ISO. In some embodiments, the brightness is about 92%. In some embodiments, the brightness ranges from about 91% to about 93%, or from about 92% to about 93%.

The kraft fiber of the disclosure has a CIE whiteness of at least about 84, for example, at least about 85, for example, at least about 86, for example, at least about 87. CIE Whiteness is measured according to TAPPI Method T560.

In some embodiments, cellulose according to the present disclosure has an R18 value in the range of from about 87.5% to about 88.4%, for instance R18 has a value of at least about 88.0%, for instance about 88.1%.

In some embodiments, kraft fiber according to the disclosure has an R10 value ranging from about 86% to about 87.5%, for instance from about 86.0% to about 87.0%, for example from about 86.2% to about 86.8%. The R18 and R10 content is described in TAPPI T235. R10 represents the residual undissolved material that is left after extraction of the pulp with 10 percent by weight caustic and R18 represents the residual amount of undissolved material left after extraction of the pulp with an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the R10 value and the R18 value, (R=R18-R10), represents the amount of chemically degraded short chained cellulose that is present in the pulp sample.

In some embodiments, modified cellulose fiber has an S10 caustic solubility ranging from about 12.5% to about 14.5%, or from about 13% to about 14%. In some embodiments, modified cellulose fiber has an S18 caustic solubility ranging from about 11.5% to about 14%, or from about 12% to about 13%.

In some embodiments, kraft fiber of the disclosure is more compressible and/or embossable than standard kraft fiber. In some embodiments, kraft fiber may be used to produce structures that are thinner and/or have higher density than structures produced with equivalent amounts of standard kraft fiber.

In some embodiments, kraft fiber of the disclosure may be formed into pulp sheets and pressed and compressed. These sheets of pulp have a density of about 0.59 g/cc or greater, for example, about 0.59-0.60 g/cc and a caliper of less than about 1.2 mm, for example, less than about 1.9 mm, for example, less than about 1.18 mm.

The present disclosure provides kraft fiber with low and ultra-low viscosity. Unless otherwise specified, "viscosity" as used herein refers to 0.5% Capillary CED viscosity measured according to TAPPI T230-om99 as referenced in the protocols.

Unless otherwise specified, "DP" as used herein refers to average degree of polymerization by weight (DPw) calculated from 0.5% Capillary CED viscosity measured according to TAPPI T230-om99. See, e.g., J. F. Cellucon Conference in *The Chemistry and Processing of Wood and Plant Fibrous Materials*, p. 155, test protocol 8, 1994 (Woodhead Publishing Ltd., Abington Hall, Abinton Cambridge CBI 6AH England, J. F. Kennedy et al. eds.) "Low DP" means a DP ranging from about 1160 to about 1860 or a viscosity ranging from about 7 to about 13 mPa·s. "Ultra low DP" fibers means a DP ranging from about 350 to about 1160 or a viscosity ranging from about 3 to about 7 mPa·s.

In some embodiments, modified cellulose fiber has a viscosity ranging from about 7.0 mPa·s to about 10 mPa·s. In some embodiments, the viscosity ranges from about 7.5 mPa·s to about 10 mPa·s. In some embodiments, the viscosity ranges from about 7.0 mPa·s to about 8.0 mPa·s. In some embodiments, the viscosity ranges from about 7.0 mPa·s to about 7.5 mPa·s. In some embodiments, the viscosity is less than 10 mPa·s, less than 8 mPa·s, less than 7.5 mPa·s, less than 7 mPa·s, or less than 6.5 mPa·s.

In some embodiments, kraft fiber of the disclosure maintains its fiber length during the bleaching process.

"Fiber length" and "average fiber length" are used interchangeably when used to describe the property of a fiber and mean the length-weighted average fiber length. Therefore, for example, a fiber having an average fiber length of 2 mm should be understood to mean a fiber having a length-weighted average fiber length of 2 mm.

In some embodiments, when the kraft fiber is a softwood fiber, the cellulose fiber has an average fiber length, as measured in accordance with Test Protocol 12, described in the Example section below, that is about 2 mm or greater. In some embodiments, the average fiber length is no more than about 3.7 mm. In some embodiments, the average fiber length is at least about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, or about 3.7 mm. In some embodiments, the average fiber length ranges from about 2 mm to about 3.7 mm, or from about 2.2 mm to about 3.7 mm.

In some embodiments, modified kraft fiber of the disclosure has increased carboxyl content relative to standard kraft fiber.

In some embodiments, modified cellulose fiber has a carboxyl content ranging from about 2 meq/100 g to about 4 meq/100 g. In some embodiments, the carboxyl content ranges from about 3 meq/100 g to about 4 meq/100 g. In some embodiments, the carboxyl content is at least about 2 meq/100 g, for example, at least about 2.5 meq/100 g, for example, at least about 3.0 meq/100 g, for example, at least about 3.5 meq/100 g.

Kraft fiber of the disclosure may be more flexible than standard kraft fiber, and may elongate and/or bend and/or exhibit elasticity and/or increase wicking. Additionally, it is expected that the kraft fiber of the disclosure would be softer than standard kraft fiber, enhancing their applicability in absorbent product applications, for example, such as diaper and bandage applications.

III. Products Made from Kraft Fibers

The present disclosure provides products made from the kraft fiber described herein. In some embodiments, the products are those typically made from standard kraft fiber. In other embodiments, the products are those typically made from cotton linter, pre-hydrolsis kraft or sulfite pulp. More specifically, fiber of the present invention can be used, without further modification, in the production of absorbent products and as a starting material in the preparation of chemical derivatives, such as ethers and esters. Heretofore, fiber has not been available which has been useful to replace both high alpha content cellulose, such as cotton and sulfite pulp, as well as traditional kraft fiber.

Phrases such as "which can be substituted for cotton linter (or sulfite pulp) . . . " and "interchangeable with cotton linter (or sulfite pulp) . . . " and "which can be used in place of cotton linter (or sulfite pulp) . . . " and the like mean only that the fiber has properties suitable for use in the end application normally made using cotton linter (or sulfite pulp or pre-hydrolysis kraft fiber). The phrase is not intended to mean that the fiber necessarily has all the same characteristics as cotton linter (or sulfite pulp).

In some embodiments, the products are absorbent products, including, but not limited to, medical devices, including wound care (e.g. bandage), baby diapers nursing pads, adult incontinence products, feminine hygiene products, including, for example, sanitary napkins and tampons, air-laid non-woven products, air-laid composites, "table-top" wipers, napkin, tissue, towel and the like. Absorbent products according to the present disclosure may be disposable. In those embodiments, fiber according to the invention can be used as a whole or partial substitute for the bleached hardwood or softwood fiber that is typically used in the production of these products.

In some embodiments, the kraft fiber of the present invention is in the form of fluff pulp and has one or more properties that make the kraft fiber more effective than conventional fluff pulps in absorbent products. More specifically, kraft fiber of the present invention may have improved compressibility which makes it desirable as a substitute for currently available fluff pulp fiber. Because of the improved compressibility of the fiber of the present disclosure, it is useful in embodiments which seek to produce thinner, more compact absorbent structures. One skilled in the art, upon understanding the compressible nature of the fiber of the present disclosure, could readily envision absorbent products in which this fiber could be used. By way of example, in some embodiments, the disclosure provides an ultrathin hygiene product comprising the kraft fiber of the disclosure. Ultra-thin fluff cores are typically used in, for example, feminine hygiene products or baby diapers. Other products which could be produced with the fiber of the present disclosure could be anything requiring an absorbent core or a compressed absorbent layer. When compressed, fiber of the present invention exhibits no or no substantial loss of absorbency, but shows an improvement in flexibility.

Fiber of the present invention may, without further modification, also be used in the production of absorbent products including, but not limited to, tissue, towel, napkin and other paper products which are formed on a traditional papermaking machine: Traditional papermaking processes involve the preparation of an aqueous fiber slurry which is typically deposited on a forming wire where the water is thereafter removed. The kraft fibers of the present disclosure may provide improved product characteristics in products including these fibers.

In some embodiments, the modified kraft of the present disclosure, without further modification, can be used in the manufacture of cellulose ethers (for example carboxymethylcellulose) and esters as a whole or partial substitute for fiber with very high DP from about 2950 to about 3980 (i.e., fiber having a viscosity, as measured by 0.5% Capillary CED, ranging from about 30 mPa·s to about 60 mPa·s) and a very high percentage of cellulose (for example 95% or greater) such as those derived from cotton linters and from bleached softwood fibers produced by the acid sulfite pulping process.

In some embodiments, this disclosure provides a kraft fiber that can be used as a whole or partial substitute for cotton linter or sulfite pulp. In some embodiments, this disclosure provides a kraft fiber that can be used as a substitute for cotton linter or sulfite pulp, for example in the manufacture of cellulose ethers, cellulose acetates and microcrystalline cellulose.

In some embodiments, the kraft fiber is suitable for the manufacture of cellulose ethers. Thus, the disclosure provides a cellulose ether derived from a kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the kraft fiber is suitable for the manufacture of cellulose esters. Thus, the disclosure provides a cellulose ester, such as a cellulose acetate, derived from kraft fibers of the disclosure. In some embodiments, the disclosure provides a product comprising a cellulose acetate derived from the kraft fiber of the disclosure. For example, and not by way of limitation, the cellulose esters of the disclosure may be used in, home furnishings, cigarettes, inks, absorbent products, medical devices, and plastics including, for example, LCD and plasma screens and windshields.

In some embodiments, the kraft fiber is suitable for the manufacture of microcrystalline cellulose. Microcrystalline cellulose production requires relatively clean, highly purified starting cellulosic material. As such, traditionally, expensive sulfite pulps have been predominantly used for its production. The present disclosure provides microcrystalline cellulose derived from kraft fiber of the disclosure. Thus, the disclosure provides a cost-effective cellulose source for microcrystalline cellulose production. In some embodiments, the microcrystalline cellulose is derived from kraft fiber having an R18 value ranging from about 87.5% to about 90%, for instance from about 88% to about 90%, for example from about 88% to about 89%.

The cellulose of the disclosure may be used in any application that microcrystalline cellulose has traditionally been used. For example, and not by way of limitation, the cellulose of the disclosure may be used in pharmaceutical or nutraceutical applications, food applications, cosmetic applications, paper applications, or as a structural composite. For instance, the cellulose of the disclosure may be a binder, diluent, disintegrant, lubricant, tabletting aid, stabilizer, texturizing agent, fat replacer, bulking agent, anticaking agent, foaming agent, emulsifier, thickener, separating agent, gelling agent, carrier material, opacifier, or viscosity modifier. In some embodiments, the microcrystalline cellulose is a colloid.

In some embodiments, the kraft fiber of the invention is suitable for the manufacture of viscose. Thus, the disclosure provides a viscose fiber derived from a kraft fiber as described. In some embodiments, the viscose fiber is produced from kraft fiber of the present disclosure that is treated with alkali and carbon disulfide to make a solution called viscose, which is then spun into dilute sulfuric acid and sodium sulfate to reconvert the viscose into cellulose. It is believed that the viscose fiber of the disclosure may be used in any application where viscose fiber is traditionally used. For example, and not by way of limitation, the viscose fiber of the disclosure may be used in rayon, cellophane, filament, food casings, and tire cord.

In some embodiments, the kraft fiber of the invention is suitable for the manufacture of nitrocellulose. Thus, the disclosure provides a nitrocellulose derived from a kraft fiber as described. In some embodiments, the nitrocellulose is produced from kraft fiber of the present disclosure that is treated with sulfuric acid and nitric acid or another nitrating compound. It is believed that the nitrocellulose of the disclosure may be used in any application where nitrocellulose is traditionally used. For example, and not by way of limitation, the nitrocellulose of the disclosure may be used in munitions, gun cotton, nail polish, coatings, and lacquers.

Other products comprising cellulose derivatives and microcrystalline cellulose derived from kraft fibers according to the disclosure may also be envisaged by persons of ordinary skill in the art. Such products may be found, for example, in cosmetic and industrial applications.

As used herein, "about" is meant to account for variations due to experimental error. All measurements are understood to be modified by the word "about", whether or not "about" is explicitly recited, unless specifically stated otherwise. Thus, for example, the statement "a fiber having a length of 2 mm" is understood to mean "a fiber having a length of about 2 mm."

The details of one or more non-limiting embodiments of the invention are set forth in the examples below. Other embodiments of the invention should be apparent to those of ordinary skill in the art after consideration of the present disclosure.

EXAMPLES

A. Test Protocols

1. Caustic solubility (R10, SW, R18, S18) is measured according to TAPPI T235-cm00.
2. Carboxyl content is measured according to TAPPI T237-cm98.
3. Aldehyde content is measured according to Econotech Services LTD, proprietary procedure ESM 055B.
4. Copper Number is measured according to TAPPI T430-cm99.
5. Carbonyl content is calculated from Copper Number according to the formula: carbonyl=(Cu. No.−0.07)/0.6, from *Biomacromolecules* 2002, 3, 969-975.
6. 0.5% Capillary CED Viscosity is measured according to TAPPI T230-om99.
7. Intrinsic Viscosity is measured according to ASTM D1795 (2007).
8. DP is calculated from 0.5% Capillary CED Viscosity according to the formula: DPw=−449.6+598.4 ln (0.5% Capillary CED)+118.02 ln 2 (0.5% Capillary CED), from the 1994 Cellucon Conference published in *The Chemistry and Processing Of Wood And Plant Fibrous Materials*, p. 155, woodhead Publishing Ltd, Abington Hall, Abington, Cambridge CBI 6AH, England, J. F. Kennedy, et al. editors.
9. Carbohydrates are measured according to TAPPI T249-cm00 with analysis by Dionex ion chromatography.
10. Cellulose content is calculated from carbohydrate composition according to the formula: Cellulose=Glucan−(Mannan/3), from *TAPPI Journal* 65(12):78-80 1982.
11. Hemicellulose content is calculated from the sum of sugars minus the cellulose content.
12. Fiber length and coarseness is determined on a Fiber Quality Analyzer™ from OPTEST, Hawkesbury, Ontario, according to the manufacturer's standard procedures.
13. DCM (dichloromethane) extractives are determined according to TAPPI T204-cm97.
14. Iron content is determined by acid digestion and analysis by ICP.
15. Ash content is determined according to TAPPI. T211-om02.
16. Peroxide residual is determined according to Interox procedure.
17. Brightness is determined according to TAPPI T525-om02.
18. Porosity is determined according to TAPPI 460-om02.
19. Fiber Length and shape factor are determined on an L&W Fiber Tester from Lorentzen & Wettre, Kista, Sweden, according to the manufacturer's standard procedures.
20. Dirt and shives are determined according to TAPPI T213-om01
21. CIE Whiteness is determined according to TAPPI Method T560

Example 1

Methods of Preparing Fibers of the Disclosure

Southern pine cellulose was digested in a continuous digester with co-current liquor flow operating at a pulp production rate of 1599 T/D. 16.7% effective alkali was added to the pulp. The white liquor charge was distributed between the impregnator and the digester with one half of the charge being applied in each. A kappa number of 20.6 was reached.

The cellulose fiber was then washed and oxygen delignified in a conventional two-stage oxygen delignification process. Oxygen was applied at a rate of 1.6% and caustic was applied at a rate of 2.1%. Delignification was carried out at a temperature of 205.5°. The Kappa number as measure at the blend chest was 7.6.

The delignified pulp was bleached in a five-stage bleach plant, with a sequence of D(EOP)D(EP)D. The first D stage ($D_0$) was carried out at a temperature of 144.3° F. and at a pH of 2.7. Chlorine dioxide was applied in an amount of 0.9%. Acid was applied in an amount of 17.8 lbs/ton.

The first E stage ($E_1$), was carried out at a temperature of 162.9° F. and at a pH of 11.2. Caustic was applied in an amount of 0.8%. Oxygen was applied in an amount of 10.8 lbs/ton. Hydrogen Peroxide was application in an amount of 6.7 lbs/ton.

The second D stage ($D_1$) was carried out at a temperature of about 161.2° F. and at a pH of 3.2. Chlorine dioxide was applied in an amount of 0.7%. Caustic was applied in an amount of 0.7 lbs/ton.

The second E stage ($E_2$) was carried out at a temperature of 164.8° F. and at a pH of 10.7. Caustic was applied in an amount of 0.15%. Hydrogen peroxide was in an amount of 0.14%.

The third D stage ($D_2$) was carried out at a temperature of 176.6° F. and at a pH of 4.9. Chlorine dioxide was applied in an amount of 0.17%.

Results are set forth in the Table below.

TABLE 1

| Sample | | 1 | 2 | 3 |
|---|---|---|---|---|
| R10 | % | 86.1 | 86.5 | 86.7 |
| S10 | % | 13.9 | 13.5 | 13.3 |
| R18 | % | 88.1 | 87.8 | 87.7 |
| S18 | % | 11.9 | 12.2 | 12.3 |
| DR | | 2.0 | 1.3 | 1.0 |
| Carboxyl | meq/100 g | 3.6 | 3.47 | |
| Aldehydes | meq/100 g | 0.47 | 0.63 | |
| Copper No. | | 0.41 | 0.4 | |
| Calculated Carbonyl* | mmole/100 g | 0.57 | 0.55 | |
| CED Viscosity | mPa · s | 8.83 | | |

TABLE 1-continued

| Sample | | 1 | 2 | 3 |
|---|---|---|---|---|
| Intrinsic Viscosity | [h] dl/g | 5.27 | | |
| Calculated Intrinsic Visc. | [h] dl/g | 5.42 | | |
| Calculated DP*** | $DP_w$ | 1414 | | |
| Glucan | % | 82.2 | 83.4 | |
| Xylan | % | 10.0 | 8.9 | |
| Galactan | % | 0.1 | <0.1 | |
| Mannan | % | 5.9 | 5.8 | |
| Arabinan | % | 0.6 | 0.2 | |
| Calculated Cellulose** | % | 80.2 | 81.5 | |
| Calculated Hemicelllulose | % | 18.5 | 16.8 | |
| Sum Sugars | | 98.8 | 98.4 | |
| DCM extractives | | 0.006 | | <0.1 |
| Iron | ppm | | | |
| Manganese | ppm | | | |

Example 2

Southern pine cellulose was digested in a continuous digester with co-current liquor flow operating at a pulp production rate of 1676 T/D. 16.5% effective alkali was added to the pulp. The white liquor charge was distributed between the impregnator and the digester with one half of the charge being applied in each. A kappa number of 20.9 was reached.

The cellulose fiber was then washed and oxygen delignified in a conventional two-stage oxygen delignification process. Oxygen was applied at a rate of 2% and caustic was applied at a rate of 2.9%. Delignification was carried out at a temperature of 206.1°. The Kappa number as measure at the blend chest was 7.3.

The delignified pulp was bleached in a five-stage bleach plant, with a sequence of D(EOP)D(EP)D. The first D stage ($D_0$) was carried out at a temperature of 144.06° F. and at a pH of 2.3. Chlorine dioxide was applied in an amount of 1.9%. Acid was applied in an amount of 36.5 lbs/ton.

The first E stage ($E_1$), was carried out at a temperature of 176.2° F. and at a pH of 11.5. Caustic was applied in an amount of 1.1%. Oxygen was applied in an amount of 10.9 lbs/ton. Hydrogen Peroxide was application in an amount of 8.2 lbs/ton.

The second D stage ($D_1$) was carried out at a temperature of 178.8° F. and at a pH of 3.8. Chlorine dioxide was applied in an amount of 0.8%. Caustic was applied in an amount of 0.07 lbs/ton.

The second E stage ($E_2$) was carried out at a temperature of 178.5° F. and at a pH of 10.8. Caustic was applied in an amount of 0.17%. Hydrogen peroxide was in an amount of 0.07%.

The third D stage ($D_2$) was carried out at a temperature of 184.7° F. and at a pH of 5.0. Chlorine dioxide was applied in an amount of 0.14%.

Results are set forth in the Table below.

TABLE 2

| Sample | | 1 | 2 | 3 | 4 |
|---|---|---|---|---|---|
| R10 | % | 86.8 | 86.5 | 86.5 | 86.8 |
| S10 | % | 13.2 | 13.5 | 13.5 | 13.2 |
| R18 | % | 87.8 | 87.8 | 87.9 | 87.0 |

TABLE 2-continued

| Sample | | 1 | 2 | 3 | 4 |
|---|---|---|---|---|---|
| S18 | % | 12.2 | 12.2 | 12.1 | 13.0 |
| ΔR | | 1.0 | 1.3 | 1.4 | 0.2 |
| Carboxyl | meq/100 g | 3.25 | 3.36 | 3.35 | |
| Aldehydes | meq/100 g | 0.74 | 2.20 | 0.91 | |
| Copper No. | | 0.37 | 0.35 | 0.37 | |
| Calculated Carbonyl* | mmole/100 g | 0.50 | 0.47 | 0.50 | |
| CED Viscosity | mPa · s | 11.4 | 11.4 | 11.4 | 11.4 |
| Intrinsic Viscosity | [η] dl/g | | | | |
| Calculated Intrinsic Visc. | [η] dl/g | 6.24 | 6.24 | 6.24 | 6.24 |
| Calculated DP*** | $DP_w$ | 1706 | 1706 | 1706 | 1706 |
| Glucan | % | 81.4 | 82.0 | 82.9 | 83.1 |
| Xylan | % | 8.0 | 8.4 | 8.6 | 8.5 |
| Galactan | % | 0.2 | 0.2 | 0.2 | 0.4 |
| Mannan | % | 6.6 | 6.5 | 6.6 | 6.4 |
| Arabinan | % | 0.3 | 0.3 | 0.4 | 0.6 |
| Calculated Cellulose** | % | 79.2 | 79.8 | 80.7 | 81.0 |
| Calculated Hemicelllulose | % | 17.1 | 17.4 | 17.8 | 17.6 |
| Sum Sugars | | 96.5 | 97.4 | 98.7 | 99.0 |
| DCM extractives | | 0.012 | | | |
| Iron | ppm | | 1.5 | 1.4 | |
| Manganese | ppm | | 0.179 | 0.195 | |

Example 3

Southern pine cellulose was digested in a continuous digester with co-current liquor flow operating at a pulp production rate of 1715 T/D. 16.9% of effective alkali was added to the pulp. The white liquor charge was distributed between the impregnator and the digester with one half of the charge being applied in each. Digestion was carried out at a temperature of 329.2° F. A kappa number of 19.4 was reached.

The cellulose fiber was then washed and oxygen delignified in a conventional two-stage oxygen delignification process. Oxygen was applied at a rate of 2% and caustic was applied at a rate of 3.2%. Delignification was carried out at a temperature of 209.4°. The Kappa number as measure at the blend chest was 7.5.

The delignified pulp was bleached in a five-stage bleach plant, with a sequence of D(EOP)D(EP)D. The first D stage ($D_0$) was carried out at a temperature of 142.9° F. and at a pH of 2.5. Chlorine dioxide was applied in an amount of 1.3%. Acid was applied in an amount of 24.4 lbs/ton.

The first E stage ($E_1$), was carried out at a temperature of 173.0° F. and at a pH of 11.4. Caustic was applied in an amount of 1.21%. Oxygen was applied in an amount of 10.8 lbs/ton. Hydrogen Peroxide was application in an amount of 7.4 lbs/ton.

The second D stage ($D_1$) was carried out at a temperature of at least about 177.9° F. and at a pH of 3.7. Chlorine dioxide was applied in an amount of 0.7%. Caustic was applied in an amount of 0.34 lbs/ton.

The second E stage ($E_2$) was carried out at a temperature of 175.4° F. and at a pH of 11. Caustic was applied in an amount of 0.4%. Hydrogen peroxide was in an amount of 0.1%.

The third D stage ($D_2$) was carried out at a temperature of 178.2° F. and at a pH of 5.4. Chlorine dioxide was applied in an amount of 0.15%.

Results are set forth in the Table below.

TABLE 3

| Sample | | 1 | 2 | 3 | 4 |
|---|---|---|---|---|---|
| R10 | % | 86.4 | 86.2 | 86.4 | 87.0 |
| S10 | % | 13.6 | 13.8 | 13.6 | 13.0 |
| R18 | % | 86.8 | 87.8 | 88.0 | 87.9 |
| S18 | % | 13.2 | 12.2 | 12.0 | 12.1 |
| ΔR | | 0.4 | 1.6 | 1.6 | 0.9 |
| Carboxyl | meq/100 g | | 3.77 | 3.70 | 3.74 |
| Aldehydes | meq/100 g | | 0.42 | 0.57 | 0.56 |
| Copper No. | | | 0.37 | 0.35 | 0.36 |
| Calculated Carbonyl* | mmole/100 g | | 0.50 | 0.47 | 0.48 |
| CED Viscosity | mPa · s | | 10.6 | 9.2 | 9.2 |
| Intrinsic Viscosity | [η] dl/g | | | | |
| Calculated Intrinsic Visc. | [η] dl/g | | 6.01 | 5.55 | 5.55 |
| Calculated DP*** | $DP_w$ | | 1621 | 1460 | 1460 |
| Glucan | % | 80.2 | 85.4 | 84.4 | 84.2 |
| Xylan | % | 8.3 | 8.7 | 8.5 | 8.9 |
| Galactan | % | 0.4 | 0.2 | 0.2 | 0.2 |
| Mannan | % | 6.3 | 5.8 | 5.8 | 5.7 |
| Arabinan | % | 0.6 | 0.4 | 0.3 | 0.3 |
| Calculated Cellulose** | % | 78.1 | 83.5 | 82.5 | 82.3 |
| Calculated Hemicelllulose | % | 17.7 | 18.7 | 19.7 | 20.7 |
| Sum Sugars | | 95.8 | 100.5 | 99.3 | 99.3 |
| DCM extractives | | | | | |
| Iron | ppm | | 0.84 | 0.97 | 0.95 |
| Manganese | ppm | | 0.2 | 0.24 | 0.45 |

TABLE 4

| Sample | | 1 | 2 | 3 |
|---|---|---|---|---|
| R10 | % | 86 | 86.2 | 86.2 |
| S10 | % | 14 | 13.8 | 13.8 |
| R18 | % | 87.8 | 87.8 | 87.8 |
| S18 | % | 12.2 | 12.2 | 12.2 |
| ΔR | | 1.8 | 1.6 | 1.6 |
| Carboxyl | meq/100 g | 3.06 | 2.67 | 3.27 |
| Aldehydes | meq/100 g | 1.03 | 0.99 | 0.06 |
| Copper No. | | 0.28 | 0.34 | 0.27 |
| Calculated Carbonyl* | mmole/100 g | 0.35 | 0.45 | 0.33 |
| CED Viscosity | mPa · s | 8 | 8.9 | 8.9 |
| Intrinsic Viscosity | [η] dl/g | | | |
| Calculated Intrinsic Visc. | [η] dl/g | 5.10 | 5.44 | 5.44 |
| Calculated DP*** | $DP_w$ | 1305 | 1423 | 1423 |
| Glucan | % | 86.2 | 86.2 | 86.4 |
| Xylan | % | 8.5 | 7.5 | 8.7 |
| Galactan | % | 0.2 | 0.3 | 0.2 |
| Mannan | % | 5.0 | 4.7 | 5.3 |
| Arabinan | % | 0.4 | 0.4 | 0.3 |
| Calculated Cellulose** | % | 82.3 | 82.3 | 82.3 |
| Calculated Hemicelllulose | % | 20.7 | 20.7 | 20.7 |
| Sum Sugars | | 100.2 | 99.0 | 101.0 |
| DCM extractives | | | | |
| Iron | ppm | 1.66 | 1.76 | 1.64 |
| Manganese | ppm | 0.27 | 0.34 | 0.34 |

Example 4

1680 tons of Southern pine cellulose was digested in a continuous digester with co-current liquor flow operating at a pulp production rate of 1680 T/D. 18.0% effective alkali was added to the pulp. The white liquor charge was distributed between the impregnator and the digester with one half of the charge being applied in each. A kappa number of 17 was reached.

The cellulose fiber was then washed and oxygen delignified in a conventional two-stage oxygen delignification process. Oxygen was applied at a rate of 2% and caustic was applied at a rate of 3.15%. Delignification was carried out at a temperature of 210°. The Kappa number as measure at the blend chest was 6.5.

The delignified pulp was bleached in a five-stage bleach plant, with a sequence of D(EOP)D(EP)D. The first D stage ($D_0$) was carried out at a temperature of 140° F. Chlorine dioxide was applied in an amount of 1.3%. Acid was applied in an amount of 15 lbs/ton.

The first E stage ($E_1$), was carried out at a temperature of 180° F. Caustic was applied in an amount of 1.2%. Oxygen was applied in an amount of 10.5 lbs/ton. Hydrogen Peroxide was application in an amount of 8.3 lbs/ton.

The second D stage ($D_1$) was carried out at a temperature of at least about 180° F. Chlorine dioxide was applied in an amount of 0.7%. Caustic was not applied.

The second E stage ($E_2$) was carried out at a temperature of 172° F. Caustic was applied in an amount of 0.4%. Hydrogen peroxide was in an amount of 0.08%.

The third D stage ($D_2$) was carried out at a temperature of 180° F. Chlorine dioxide was applied in an amount of 0.18%.

Results are set forth in the Table below.

Example 5

Characteristics of the fiber samples produced according to the Examples above, including whiteness and brightness were measured. The results are reported below.

| Brightness Measurements | | | | | |
|---|---|---|---|---|---|
| Sheets | | | | | |
| Illuminant/Observer D65/10 | | | Illuminant/Observer C/2 | | |
| Example 2 | Avg. | σ | Example 2 | Avg. | σ |
| L* | 98.6 | 0.04 | L* | 98.4 | 0.08 |
| a* | −0.72 | 0.02 | a* | −0.9 | 0.02 |
| b* | 1.9 | 0.08 | b* | 1.75 | 0.06 |
| Brightness | 94.01 | 0.23 | Brightness | 93.59 | 0.24 |
| Whiteness Index | 85.27 | 0.71 | Whiteness Index | 85.41 | 0.55 |
| TAPPI Brightness Pads | | | | | |
| Illuminant/Observer D65/10 | | | Illuminant/Observer C/2 | | |
| Example 2 | Avg. | σ | Example 2 | Avg. | σ |
| L* | 98.49 | 0.09 | L* | 98.08 | 0.15 |
| a* | −0.74 | 0.02 | a* | −0.86 | 0.01 |
| b* | 1.89 | 0.04 | b* | 1.74 | 0.07 |
| Brightness | 93.78 | 0.23 | Brightness | 93.87 | 0.19 |
| Whiteness Index | 85.01 | 0.50 | Whiteness Index | 84.84 | 0.17 |
| Sheets | | | | | |
| Illuminant/Observer D65/10 | | | Illuminant/Observer C/2 | | |
| Example 3 | Avg. | σ | Example 3 | Avg. | σ |
| L* | 98.25 | 0.06 | L* | 98.29 | 0.00 |
| a* | −0.54 | 0.02 | a* | −0.72 | 0.02 |

-continued

| Brightness Measurements | | | | | |
|---|---|---|---|---|---|
| b* | 1.63 | 0.08 | b* | 1.65 | 0.07 |
| Brightness | 93.54 | 0.17 | Brightness | 93.39 | 0.13 |
| Whiteness Index | 86.33 | 0.54 | Whiteness Index | 86.28 | 0.38 |
| Dryer lab measured brightness | 92.2 | | | | |

| Fiber of Example 3 Pulp Sheet Characteristics | | Sample 1 | Sample 2 | Sample 3 | Average |
|---|---|---|---|---|---|
| ISO Surface Brightness | % | 92.60 | 92.73 | 92.24 | 92.52 |
| L | | 97.80 | 97.83 | 97.78 | 97.80 |
| a | | −0.81 | −0.85 | −0.91 | −0.86 |
| b | | 2.38 | 2.31 | 2.61 | 2.43 |
| Fluorescence | | 0.01 | 0.06 | 0.05 | 0.04 |
| Calculated CIE Whiteness | | 85.30 | 85.70 | 84.30 | 85.10 |

| Fiber of Example 4 | | Sample 1 | Sample 2 | Sample 3 | Average |
|---|---|---|---|---|---|
| Pulp Sheet Characteristics | | | | | |
| ISO Surface Brightness | % | 92.57 | 92.68 | 92.50 | 92.58 |
| L | | 97.73 | 97.69 | 97.69 | 97.70 |
| a | | −0.74 | −0.63 | −0.70 | −0.69 |
| b | | 2.25 | 2.12 | 2.26 | 2.21 |
| Fluorescence | | 0.02 | 0.07 | 0.05 | 0.05 |
| DCME | % | 0.000 | 0.000 | 0.000 | 0.000 |
| Acid Insoluble Ash | | | | | |
| Total Ash | % | 0.083 | 0.083 | 0.079 | 0.082 |
| AIA | ppm | 135 | 75 | 35 | 82 |
| Sand Content | ppm | 0 | 0 | 0 | 0 |

Example 6

The solubility of fiber produced by a method consistent with Examples 1-4 was tested for S10, S18, R10 and R18 values. The results are set forth below.

| | Solubility of Pulp (%)(average) | | % Retained | |
|---|---|---|---|---|
| Sample | $S_{10}$ | $S_{18}$ | $R_{10}$ | $R_{18}$ |
| Sample A, after 5-stage bleaching | 12.8 | 11.9 | 87.2 | 88.1 |

| | Solubility of Pulp (%)(average) | | % Retained | |
|---|---|---|---|---|
| Sample | $S_{10}$ | $S_{18}$ | $R_{10}$ | $R_{18}$ |
| Sample B, after 5-stage bleaching | 13.8 | 13.3 | 86.2 | 86.7 |

Example 7

The carbohydrate content of fiber produced by the method of Example 5 were measured. The first two tables below report data based upon an average of two determinations. The first table is the fiber of the present invention and the second table is the control. The second two tables are values normalized to 100%.

| Inventive Sample | Carbohydrates | | | | | |
|---|---|---|---|---|---|---|
| | Arabinan % | Galactan % | Glucan % | Xylan % | Mannan % | Carbohydrates % |
| Brownstock | 0.48 | 0.34 | 81.90 | 9.13 | 6.46 | 98.31 |
| Decker (O2 system) | 0.43 | 0.27 | 81.03 | 8.67 | 6.19 | 96.59 |
| E1 | 0.42 | 0.23 | 84.47 | 8.78 | 6.30 | 100.20 |
| D1 | 0.45 | 0.26 | 86.17 | 9.18 | 6.52 | 102.58 |
| E2 | 0.37 | 0.24 | 86.44 | 8.86 | 6.46 | 102.37 |
| D2 | 0.45 | 0.24 | 84.97 | 8.92 | 6.45 | 101.04 |

| Control | Carbohydrates | | | | | |
|---|---|---|---|---|---|---|
| | Arabinan % | Galactan % | Glucan % | Xylan % | Mannan % | Carbohydrates % |
| Brownstock | 0.64 | 0.42 | 81.24 | 9.97 | 6.74 | 99.01 |
| Decker (O2 system) | 0.62 | 0.30 | 82.86 | 9.78 | 6.62 | 100.18 |
| E1 | 0.60 | 0.29 | 83.34 | 9.72 | 6.62 | 100.58 |
| D1 | 0.55 | 0.26 | 83.46 | 9.66 | 6.56 | 100.49 |
| E2 | 0.47 | 0.26 | 83.20 | 9.52 | 6.49 | 99.94 |
| D2 | 0.55 | 0.27 | 84.64 | 9.75 | 6.66 | 101.88 |

| Normalized | Carbohydrates | | | | | |
|---|---|---|---|---|---|---|
| | Arabinan % | Galactan % | Glucan % | Xylan % | Mannan % | Carbohydrates % |
| Brownstock | 0.48 | 0.35 | 83.31 | 9.28 | 6.57 | 100.00 |
| Decker (O2 system) | 0.45 | 0.28 | 83.89 | 8.97 | 6.41 | 100.00 |
| E1 | 0.42 | 0.23 | 84.31 | 8.76 | 6.28 | 100.00 |
| D1 | 0.44 | 0.25 | 84.01 | 8.95 | 6.35 | 100.00 |
| E2 | 0.37 | 0.24 | 84.44 | 8.65 | 6.31 | 100.00 |
| D2 | 0.45 | 0.24 | 84.10 | 8.83 | 6.38 | 100.00 |

| Control | Carbohydrates | | | | | |
|---|---|---|---|---|---|---|
| | Arabinan % | Galactan % | Glucan % | Xylan % | Mannan % | Carbohydrates % |
| Brownstock | 0.64 | 0.42 | 82.05 | 10.07 | 6.81 | 100.00 |
| Decker (O2 system) | 0.62 | 0.30 | 82.71 | 9.76 | 6.60 | 100.00 |
| E1 | 0.59 | 0.29 | 82.86 | 9.67 | 6.58 | 100.00 |
| D1 | 0.55 | 0.26 | 83.05 | 9.61 | 6.52 | 100.00 |
| E2 | 0.47 | 0.26 | 83.25 | 9.52 | 6.50 | 100.00 |
| D2 | 0.54 | 0.26 | 83.09 | 9.57 | 6.54 | 100.00 |

A number of embodiments have been described. Nevertheless, it will be understood that various modifications may be made without departing from the spirit and scope of the disclosure. Accordingly, other embodiments are within the scope of the following claims.

We claim:

1. A method of making an improved kraft fiber comprising:

digesting a softwood cellulose fiber to a kappa number of less than about 21;

oxygen delignifying the cellulose fiber to a kappa number of less than about 8;

bleaching the cellulose fiber in a multi-stage bleaching sequence to an ISO brightness from about 92% to about 94%; and wherein the first stage of the multi-stage bleaching sequence is a chlorine dioxide $D_0$ stage, and wherein the chlorine dioxide is applied in an amount of greater than about 1% chlorine dioxide on pulp.

2. The method of claim 1, wherein the CIE whiteness of the fiber after bleaching is from about 85 to about 87.

3. The method of claim 1, wherein the CIE b* value of the fiber after bleaching is less than about 2.5.

4. The method of claim 1, wherein the R18 value of the fiber after bleaching is from about 87.5% to about 90%.

5. The method of claim 1, wherein the CIE whiteness of the fiber after bleaching is from about 85 to about 87, and wherein the R18 value of the fiber after bleaching is from about 87.5% to about 90%.

6. The method of claim 1, wherein the viscosity of the fiber after bleaching is from about 7.0 mPa·s to about 10 mPa·s.

7. The method of claim 1, wherein the digestion is carried out in two stages including an impregnator and a co-current down-flow digester.

8. The method of claim 7, wherein white liquor is charged to both the impregnator and the digester and wherein the white liquor has an effective alkali of at least about 16.7%.

9. The method of claim 8, wherein digestion is carried out at a temperature of at least about 320° F.

10. The method of claim 1, wherein the first stage of the multi-stage bleaching sequence is a chlorine dioxide $D_0$ stage, and wherein the chlorine dioxide is applied in an amount of greater than about 1.2% chlorine dioxide on pulp.

11. A method of making an improved kraft fiber comprising:

digesting and oxygen delignifying a softwood cellulose fiber to a kappa number of less than about 8;

bleaching the cellulose fiber in a multi-stage bleaching sequence to an ISO brightness from about 92% to about 94%; and wherein the first stage of the multi-stage bleaching sequence is a chlorine dioxide $D_0$ stage, and wherein the chlorine dioxide is applied in an amount of greater than about 1% chlorine dioxide on pulp.

12. The method of claim 11, wherein the CIE whiteness of the fiber after bleaching is from about 85 to about 87.

13. The method of claim 11, wherein the R18 value of the fiber after bleaching is from about 87.5% to about 90%.

14. The method of claim 11, wherein the viscosity of the fiber after bleaching is from about 7.0 mPa·s to about 10 mPa·s.

15. The method of claim 11, wherein the digestion is carried out in two stages including an impregnator and a co-current down-flow digester.

16. The method of claim 15, wherein white liquor is charged to both the impregnator and the digester and wherein the white liquor has an effective alkali of at least about 16.7%.

17. The method of claim 16, wherein digestion is carried out at a temperature of at least about 320° F.

18. The method of claim 11, wherein the first stage of the multi-stage bleaching sequence is a chlorine dioxide $D_0$ stage, and wherein the chlorine dioxide is applied in an amount of greater than about 1.2% chlorine dioxide on pulp.

19. A method of making an improved kraft fiber comprising:

digesting and oxygen delignifying a softwood cellulose fiber to a kappa number of less than about 8;

bleaching the cellulose fiber in a multi-stage bleaching sequence to an ISO brightness from about 92% to about 94%, wherein the CIE whiteness of the fiber after bleaching is from about 85 to about 87, and wherein the R18 value of the fiber after bleaching is from about 87.5% to about 90%, and wherein the first stage of the multi-stage bleaching sequence is a chlorine dioxide $D_0$ stage, and wherein the chlorine dioxide is applied in an amount of greater than about 1% chlorine dioxide on pulp.

20. The method of claim 19, wherein the CIE b* value of the fiber after bleaching is less than about 2.5.

21. The method of claim 19, wherein the viscosity of the fiber after bleaching is from about 7.0 mPa·s to about 10 mPa·s.

* * * * *